US008557083B2

(12) United States Patent
Paganelli

(10) Patent No.: US 8,557,083 B2
(45) Date of Patent: Oct. 15, 2013

(54) PROCESS FOR REALISING HIGH-RESISTANCE SLABS OR TILES, DESTINED FOR COVERING INTERNAL OR EXTERNAL FLOORS OR WALLS

(76) Inventor: Mariano Paganelli, Modena (IT)

( * ) Notice: Subject to any disclaimer, the term of this patent is extended or adjusted under 35 U.S.C. 154(b) by 550 days.

(21) Appl. No.: 12/434,925

(22) Filed: May 4, 2009

(65) Prior Publication Data

US 2010/0154339 A1 Jun. 24, 2010

(30) Foreign Application Priority Data

Dec. 24, 2008 (IT) ..... MO2008A0330

(51) Int. Cl.

| | |
|---|---|
| ***E04C 5/08*** | (2006.01) |
| ***F16L 3/00*** | (2006.01) |
| ***A61F 13/15*** | (2006.01) |
| ***B29C 65/00*** | (2006.01) |
| ***B32B 37/00*** | (2006.01) |

(52) U.S. Cl.
USPC ..... 156/297; 52/223.6; 428/49; 156/160

(58) Field of Classification Search
USPC ..... 52/223.1, 223.6, 414; 428/49; 156/153, 156/154, 297, 160
See application file for complete search history.

(56) References Cited

U.S. PATENT DOCUMENTS

| | | | | |
|---|---|---|---|---|
| 3,619,457 | A * | 11/1971 | Chandler et al. | 264/256 |
| 3,806,400 | A * | 4/1974 | Laethem | 52/223.1 |
| 5,705,250 | A * | 1/1998 | Hudson, Jr. | 428/99 |
| 6,413,618 | B1 * | 7/2002 | Parker et al. | 428/195.1 |
| 6,807,891 | B2 * | 10/2004 | Fisher | 89/36.02 |
| 6,818,275 | B2 * | 11/2004 | Guarda et al. | 428/119 |
| 7,037,865 | B1 * | 5/2006 | Kimberly | 442/181 |
| 7,478,579 | B2 * | 1/2009 | Carberry et al. | 89/36.02 |
| 7,770,345 | B2 * | 8/2010 | McConnell et al. | 52/263 |
| 2002/0160680 | A1 * | 10/2002 | Laurence et al. | 442/394 |
| 2003/0129357 | A1 * | 7/2003 | Guarda et al. | 428/119 |
| 2006/0080910 | A1 * | 4/2006 | Cornia | 52/177 |
| 2006/0230701 | A1 | 10/2006 | Pepa | |
| 2007/0251172 | A1 | 11/2007 | Cramer et al. | |

FOREIGN PATENT DOCUMENTS

| | | | |
|---|---|---|---|
| EP | 1329568 | A1 | 7/2003 |
| GB | 774 049 | * | 5/1957 |
| GB | 774049 | A | 5/1957 |
| GB | 2306389 | A | 5/1997 |
| JP | 2005002646 | A | 1/2005 |
| WO | 0067999 | A1 | 11/2000 |
| WO | 2004/090257 | A1 | 10/2004 |
| WO | 2005/052279 | A1 | 6/2005 |
| WO | 2006/042148 | A2 | 4/2006 |
| WO | 2008/056382 | A1 | 5/2008 |

* cited by examiner

*Primary Examiner* — Ryan Kwiecinski
(74) *Attorney, Agent, or Firm* — Pearne & Gordon LLP

(57) ABSTRACT

The process includes the following stages: arranging a slab or tile exhibiting an in-view surface; arranging at least a slim support slab or support plate having a characteristic of possessing a thermal expansion coefficient which is greater than a thermal expansion coefficient of the slab or tile, the slim support slab or support plate exhibiting effective properties of tenacity and resistance to easy breakage thereof; gluing under heating the slab or tile onto the slim support slab or support plate, or vice versa, using a suitable glue for adhering to surfaces thereof to be glued; leaving an assembly thus obtained to cool down to an ambient temperature such that owing to a different thermal expansion coefficient (contraction), the slim support slab or support plate induces on the slab or tile, to which it is solidly glued, a state of compression starting from a lower surface thereof which is opposite the in-view surface.

15 Claims, 1 Drawing Sheet

PROCESS FOR REALISING HIGH-RESISTANCE SLABS OR TILES, DESTINED FOR COVERING INTERNAL OR EXTERNAL FLOORS OR WALLS

FIELD OF THE INVENTION

The invention relates to a process for forming high-resistance slabs or tiles, intended for covering internal or external floors or walls.

SUMMARY OF THE INVENTION

Specifically, though not exclusively, it is usefully applied in the sector of ceramic tiles which have been successful in the market for floorings and coverings in residential buildings and public spaces thanks to their characteristics of durability and hygiene, naturally apart from the infinite possibilities of decoration they afford.

Modern known tiles are characterized by a high level of mechanical and chemical resistance, as well as resistance to surface abrasion, and are also easy to clean. For these reasons they have become very widely used.

However, ceramic material is intrinsically fragile, so that ceramic tiles, though exhibiting very high load value qualities, are by their nature not very resistant to impacts, as the mechanism propagating the rupture thereof is typical of hard-but-fragile materials: when subjected to a stress they rapidly reach breaking limit, even where the strain is very small.

For this reason ceramic tiles have to be cemented onto a very rigid support which prevents them from deforming. The prior art for installation of tiles comprises laying them on a floor which must be as rigid as possible. According to the dictates of modern laying, the floor must be reinforced with an iron mesh such as to make it even more rigid. In this way those minimum deformations which lead to the breaking of the tiles are prevented, even following impacts or intense loads.

In raised flooring, the tiles are cemented onto a rigid support of several centimeters' thickness, which prevents flexion thereof.

In the prior art, then, ceramic tiles, in order to guarantee good results, must be cemented on a very rigid substrate. The substrates normally used in the prior art for dry laying, when thin, are not sufficiently rigid, so do not guarantee resistance to breakage in case of impact. In order to guarantee resistance to impact, thicknesses of greater than 5 mm are required.

The laying or recasting of a floor according to the prior art are therefore complex and expensive operations.

In recent years, however, laminate floors have become common on the market. Laminate floors do not require special precautions and can be easily laid even by inexperienced people and without the need for special technological tools. On the back of the success of these materials which are laid without adhesive even on pre-existing floors, a strong demand for a ceramic tile floor which can be laid in the same way has been established, i.e. without being cemented to the floor or platform and which can be installed even by inexpert personnel.

BACKGROUND OF THE INVENTION

There exist prior-art realizations which comprise premounting of the ceramic tile by cementing to supports of various types, for example plastic, (see WO 2005/052279 A1—Della Pepa), polyurethane (see WO 2006/042148 A2—Mohawk), masonite (see US 2007251172 A1—Edge Flooring), or sheet metal (see WO 2008/056382 A1—Planium), and ceramic (see WO2004090257 A1—System).

In document WO 2008/056382 A1—(Planium), reference is made to the use of a metal sheet, with the sole aim of creating an anchoring between adjacent tiles. Other systems propose reinforcement with a thick natural stone slab (13-17 mm) (patent EP1329568A1—Bresciana Graniti) or a ceramic tile (patent JP 2005002646) using however rather complex manufacturing characteristics and methods.

All of these known systems have been shown to have limitations in their practical use in the field of civil construction due to poor resistance to impact in the flooring, essentially due to the intrinsic fragility of the ceramic tile. In particular the prior art exhibits the unsolved problem, not only for ceramic tiles, but especially in the case thereof, of not enabling realization of dry-laid ceramic floors provided with sufficient resistance to impacts.

The present invention obviates the above-mentioned drawbacks in the prior art by solving the problem of fragility of the ceramic material as set out in the claims.

The result is obtained by the invention with the realization of a high-resistance tile able to resist much greater impacts than those usually withstandable by traditional ceramic tiles without having to resort to use of tiles having greater thickness.

BRIEF DESCRIPTION OF THE DRAWINGS

Further characteristics and advantages of the present invention will better emerge from the detailed description that follows of some preferred though not exclusive embodiments of the invention, illustrated purely by way of non-limiting example in the accompanying figures of the drawings, in which.

DESCRIPTION OF THE PREFERRED EMBODIMENTS

Figure 1:
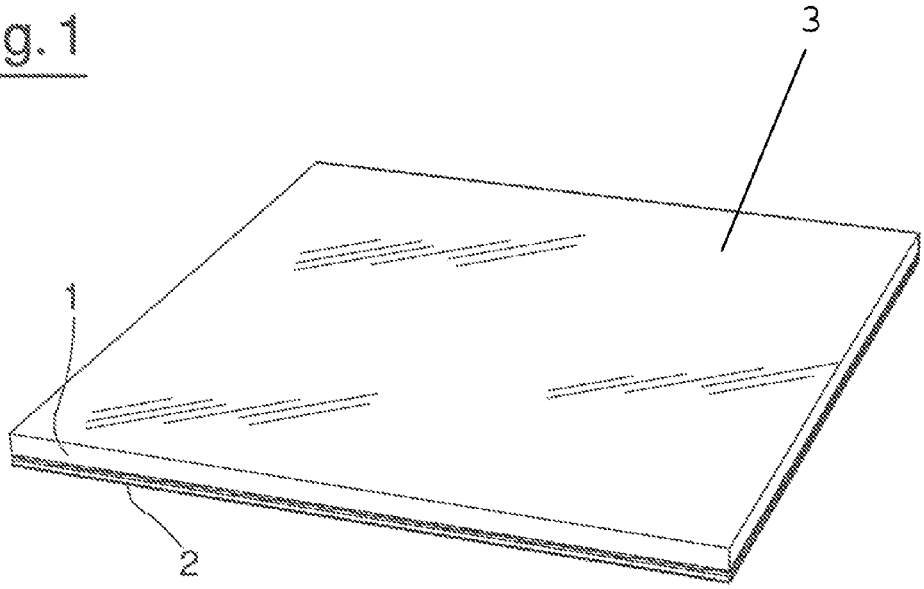
FIG. 1 is a schematic perspective view of a product made according to the invention.
Figure 2:
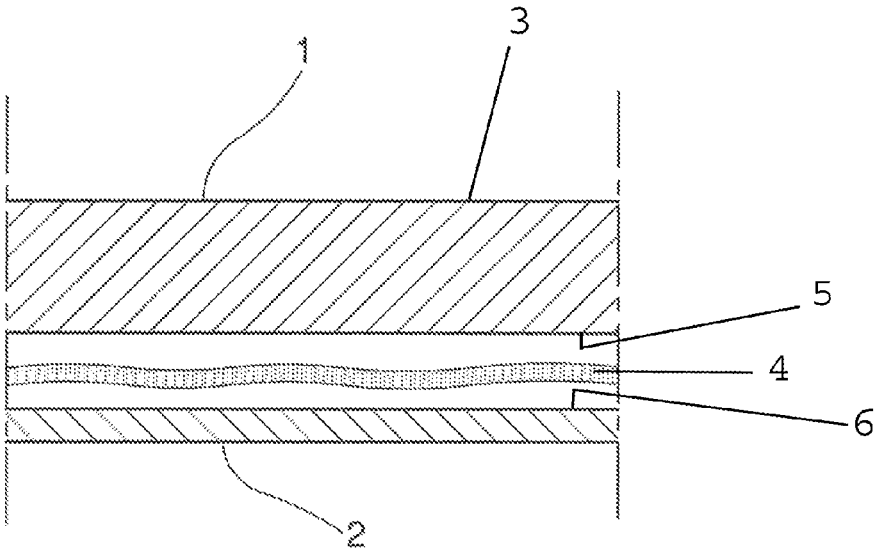
FIG. 2 is a large-scale drawing of part of a schematic exploded section of the product of the invention as in FIG. 1.

With reference to the accompanying figures, the process of the invention for realizing high-resistance slabs or tiles, destined for covering internal or external floors or walls comprises following main stages:

arranging a slab or tile 1 exhibiting a top or in-view surface 3 (aesthetic surface) and a bottom surface 5 which is opposite the in-view surface 3;

arranging at least a slim support slab or support plate 2 having a top surface 6 and having a characteristic of possessing a thermal expansion coefficient which is greater than a thermal expansion coefficient of the slab tile 1, the slim support slab or support plate 2 being characterized by having good properties of tenacity and resistance to easy breakage thereof;

gluing under heating the slab or tile 1 onto the slim support slab or support plate 2, or vice versa, using a suitable glue 4 for adhering to surfaces 5, 6 thereof to be glued; leaving an assembly thus obtained to cool down to an ambient temperature such that owing to a different thermal expansion coefficient (contraction), the slim support slab or support plate 2 induces on the slab or tile 1, to which it is solidly glued, a state of compression starting from a bottom surface 5 thereof which is opposite the in-view surface.

The slab or tile 1 is made of a ceramic material or the like which can be glazed and decorated. Further it is preferably of small thickness, i.e. a few millimeters, in comparison with the thickness normally used for floor tiles.

The at least a thin slab or support sheet 2 is preferably made of a metal or a metal alloy. In particular, it is advantageously made of galvanized iron and exhibits a slim thickness comprised between 0.1 mm and 1 mm, preferably between 0.3 mm and 0.5 mm.

The gluing under heating is performed at a temperature which is greater by a predetermined entity ΔT than a predetermined working and use temperature. The predetermined entity ΔT indicated is preferably at least 40° C. and the gluing under heating of the first slab or tile 1 on the thin support slab or sheet 2, or vice versa, comprises spreading a layer of adhesive on at least one of the two surfaces to be glued followed by a pressing stage during which the first slab or tile 1 is pressed with a predetermined pressure against the slim support slab or sheet 2.

The first slab or tile 1 is a thin ceramic tile (a few millimeters thick), usually not greater than 4 to 5 mm, while the slim support slab or sheet 2 has a thickness preferably comprised between 0.25 mm and 0.5 mm.

An important condition is however that the material constituting the slim support slab or sheet 2, apart from being a non-fragile material, also has a thermal expansion coefficient (contraction) and a modulus of elasticity which are decidedly higher than those of the slab or tile 1. Materials which can be used comprise galvanized iron, steel and aluminium alloys.

The glue used for solidly gluing under heating the slab or tile 1 on the slim support slab or sheet 2, or vice versa, is constituted by an acrylic resin, a polyurethane resin, a polyester resin or an epoxy resin.

In this way, during cooling the support slab or sheet 2 will undergo a thermal contraction which is greater than that of the slab or tile 1, subjecting to compression the lower surface of the slab or tile 1 to which the support slab or sheet 2 is adherent by means of the glue.

The high modulus of elasticity of the material of the support slab or sheet 2 guarantees that the high level of compression becomes permanent in the coupling, preventing formation of cracking during impact stress on the lower surface of the tile, which would inevitably lead to the breakage of the piece.

The composite tile thus obtained is highly resistant and essentially characterized by the fact of comprising a slab or tile 1 exhibiting an in-view surface which is solidly constrained on a slim support slab or sheet 2 provided with good properties of tenacity and resistance to easy fracture such as to be subjected to a state of compression, starting from the lower surface opposite the in-view surface, induced thereon by the slim support slab or sheet 2 which is strongly glued thereto. It is able to withstand an impact without cracking up to the point that the surface, when finally cracking, does so due to compression, and a typical hertzian fracture forms. In other words, it dents but does not shatter into pieces.

EXAMPLE N° 1

An example of this invention relates to the application to the lower surface of the ceramic slab or tile of a galvanized steel sheet having a modulus of elasticity of 200 Gpa and being 0.5 mm thick, using as a glue a polyurethane resin in a heated die at 70° C. The die is used to maintain the ceramic tile and the galvanized steel sheet positioned in relation to one another. Once the resin has completed hardening the product can be extracted from the die and subsequent cooling thereof to ambient temperature of 20-30° C. leads to a state of compression of the lower surface which enormously increases resistance to impacts thereof.

EXAMPLE N° 2

By way of instance, consider the following example in order to provide a quantification of the results achievable with the process of the invention applied to a normal vitrified stoneware tile, format 60×60 cm having a thickness of 12 mm, water absorbance of 0.012%, a thermal expansion coefficient $\alpha_{(20\text{-}100)}=7.5\times10^{-6}\ K^{-1}$ and fracture strength 55 MPa. A tile of this type, when not glued to the floor, if struck by a steel ball weighing 510 grams from a height of 100 mm shatters into many shards. If the same tile is glued to the floor using a high-resistance glue (Mapei Kerabond) it can withstand an impact by the same ball from a height of 800 mm (Certifications et classements des produits du batiment—Revetementes de sol ceramiques—Cahiers du CSTB, cahier 3503 annexe 6 choc lourd—Janvier 2005). Beyond this height, the tile glued to the floor begins to dent, but does not break into fragments.

The same type of tile is glued under heating at 50° C. with a heat-fusible reactive polyurethane resin applied by roller on the lower surface of the tile to a 0.5 mm-thick galvanized iron sheet with a thermal expansion coefficient of $\alpha_{(20\text{-}100)}=12.5\times10^{-6}\ K^{-1}$ and a modulus of elasticity of 190 GPa. The product is then left to cool. The increase in thickness of the whole product with respect to the original tile is 1.5 mm. This product, which constitutes the basis of the invention, is rested on a rigid reinforced-cement flooring without any adhesive. The invention can withstand an impact of the above-mentioned steel ball of the weight of 510 grams from a height of 800 mm striking the center of the tile. Beyond this height the surface of the product begins to dent. The behavior is entirely similar to that of the tile glued to the cement flooring.

EXAMPLE N° 3

By way of example of application of the invention, consider the use of a ceramic slab or tile 1 having a 60×60 cm format with a thickness of only 3 mm made of unglazed vitrified stoneware. This tile has a water absorption of 0.01%, a thermal expansion coefficient of $\alpha_{(20\text{-}100)}=7.2\times10^{-6}\ K^{-1}$ and a fracture strength of 60 Mpa. When rested on the floor, it shatters if stuck by the steel ball weighing 510 grams which falls from a height of 50 millimeters. If the tile is glued according to the present invention on the floor using a high-resistance adhesive it can withstand an impact of a steel ball weighing 510 grams falling from a height of 800 mm. If the ball falls from greater heights the tile dents, i.e. is damaged by crushing.

The same type of tile is then, according to the process of the present invention, glued under heating at a temperature of 50° C. on an AISI 430 stainless steel sheet having a thermal expansion coefficient of $\alpha_{(20\text{-}100)}=10\times10^{-6}\ K^{-1}$, a modulus of elasticity of 200 GPa, a fracture strength of 50 Mpa, and a thickness of 0.4 mm. The glue used is a fast-acting bicomponent epoxy adhesive having a thickness of 0.4 mm. The cooling stage follows. The product obtained has a total thickness of 3.8 mm, greater than that of the original tile 1 by only 0.8 mm and is constituted by a high-resistance tile characterized in that it comprises a slab or a tile 1 exhibiting an in-view surface which is solidly constrained on a slim support slab or support plate 2 provided with good properties of tenacity and resistance to easy breakage thereof, in such a way as to be subjected to a state of compression, starting from a lower surface opposite the in-view surface, which state of compression is induced by the slim support slab or support plate 2 which is solidly glued thereto.

Simply rested on a reinforced concrete flooring without any glue, the product is able to withstand an impact with a steel ball weighing 510 grams hitting the center of the tile falling from a height of 800 millimeters and only when the ball is dropped from greater heights does it begin to dent by force of crushing.

The product obtained, constituting a high-resistance tile, only resting on a floor, behaves as if it were solidly cemented to the actual floor.

With the invention ceramic floor laying can be done without fixing with glue or adhesive.

What is claimed is:

1. A process for forming a high-resistance tile effective for covering an internal or external floor or wall, comprising the following steps:

(a) providing a ceramic tile and a sheet, the ceramic tile being a crystalline ceramic material, the sheet being made of a metal or a metal alloy, the ceramic tile having a thermal coefficient of expansion and having an in-view surface and a bottom surface which is opposite the in-view surface, the sheet having a top surface and having a thermal coefficient of expansion which is greater than the thermal coefficient of expansion of the ceramic tile;

(b) gluing under heating the bottom surface of the ceramic tile onto the top surface of the sheet via a layer of adhesive provided between the bottom surface of the ceramic tile and the top surface of the sheet, step (b) including heating the ceramic tile and the sheet to or above a first temperature and thereafter permitting the ceramic tile on the sheet to cool down to a lower second temperature so that the ceramic tile is solidly glued to the sheet, step (b) including inducing a state of compression in the ceramic tile via the sheet thermal coefficient of expansion being greater than the ceramic tile thermal coefficient of expansion during the cooling from the first temperature, wherein the state of compression starts from the bottom surface of the ceramic tile where the bottom surface of the ceramic tile contacts the adhesive, and wherein the ceramic tile on the sheet yielded by the process is effective for covering an internal or external floor or wall with the in-view surface being in view.

2. The process of claim 1, wherein the gluing under heating comprises a spreading of the layer of adhesive on at least a surface of the two surfaces to be glued, followed by a pressing stage, during which pressing stage the ceramic tile is pressed, with a predetermined pressure, against the sheet.

3. The process of claim 1, wherein the ceramic tile has a thickness of less than 4 mm.

4. The process of claim 1, wherein the sheet is made of steel and exhibits a thickness comprised between 0.25 mm and 0.5 mm.

5. The process of claim 1, wherein the sheet is made of galvanized iron and exhibits a thickness comprised between 0.25 mm and 0.5 mm.

6. The process of claim 1, wherein the adhesive is an acrylic resin, a polyurethane resin, a polyester resin or an epoxy resin.

7. The process of claim 1, wherein the gluing under heating is performed at a temperature from 50° C. to 70° C.

8. The process of claim 1, wherein the ceramic tile has a thickness of not greater than 5 mm.

9. The process of claim 1, wherein the sheet is a metal sheet having a thickness of 0.1-1 mm.

10. The process of claim 1, wherein the first temperature is at least 40° C. above ambient temperature.

11. The process of claim 1, wherein the gluing under heating is performed at a temperature which is at least 40° C. above ambient temperature.

12. The process of claim 1, wherein the gluing under heating is performed at a temperature which is at least 60° C.

13. The process of claim 1, wherein the ceramic tile and the sheet are rectangular and the same length and width.

14. The process of claim 1, wherein the sheet is made of steel.

15. The process of claim 14, wherein the sheet has a thickness of 0.1-1 mm.

* * * * *